US006762569B1

(12) United States Patent
Holmes et al.

(10) Patent No.: US 6,762,569 B1
(45) Date of Patent: Jul. 13, 2004

(54) CONSTANT LIGHT OUTPUT CIRCUIT AND ELECTRICAL COMPONENTS BASED THEREON

(75) Inventors: Mark Holmes, Waterford, CT (US); Ronald E. Belek, Quaker Hill, CT (US)

(73) Assignee: Henkel Corporation, Rocky Hill, CT (US)

( * ) Notice: Subject to any disclaimer, the term of this patent is extended or adjusted under 35 U.S.C. 154(b) by 4 days.

(21) Appl. No.: 10/339,311

(22) Filed: Jan. 10, 2003

(51) Int. Cl.[7] ..... H05B 37/02
(52) U.S. Cl. ..... 315/307; 315/308
(58) Field of Search ..... 315/308, 307, 315/291, 209 R, 194, 224, 243, 247, 200 R, DIG. 4, DIG. 5, 360

(56) References Cited

U.S. PATENT DOCUMENTS 5,315,214 A 5/1994 Lesea ..... 315/219 R
5,578,908 A * 11/1996 Persson ..... 315/307
5,636,111 A * 6/1997 Griffin et al. ..... 363/37
5,696,431 A * 12/1997 Giannopoulos et al. ..... 315/308
6,011,363 A 1/2000 Allison ..... 315/307
6,075,326 A * 6/2000 Nostwick ..... 315/307
6,172,541 B1 * 1/2001 Young et al. ..... 327/170
6,232,727 B1 5/2001 Chee et al. ..... 315/307
6,448,713 B1 * 9/2002 Farkas et al. ..... 315/291
6,495,995 B2 * 12/2002 Groom et al. ..... 323/283
6,509,699 B2 * 1/2003 Kim et al. ..... 315/291

* cited by examiner

*Primary Examiner*—Chuc Tran
(74) *Attorney, Agent, or Firm*—Steven C. Bauman

(57) ABSTRACT

A method and apparatus for controlling the operation of a gas discharge including regulation of power provided to the lamp for maintaining constant light output throughout the lamp's life. A circuit is provided that continuously monitors the lamp voltage and current. A lamp resistance is determined by dividing the lamp voltage with the lamp current. Based on the lamp resistance, the power provided to the lamp is adjusted to maintain constant light output from the lamp.

31 Claims, 3 Drawing Sheets

CONSTANT LIGHT OUTPUT CIRCUIT AND ELECTRICAL COMPONENTS BASED THEREON

FIELD OF THE INVENTION

The present invention relates generally to field of control circuits for discharge lamps. More particular, the invention relates to control circuits to arc or discharge lamp ballast technology that maintains a constant light output as the lamp ages.

BACKGROUND OF THE RELATED TECHNOLOGY

It is well known to utilize the ballast in the gas discharge lamps to obtain high energy efficiency and long lamp life. Several prior electronic ballast and network for gas discharge lamps provide circuits to control the illumination intensity of the lamp. One such known method is provided in U.S. Pat. No. 5,315,214 to Lesea, which shows a circuit controlling the intensity of the lamp by controlling the current passing through the lamp. Also, this circuit shuts off the lamp circuit when the lamp voltage exceeds a preselected threshold. One of the disadvantages of this prior circuit is that because the lamp current remains constant, the illumination intensity of the lamp will vary with impedance changes caused by the age of the lamp. Furthermore, by sensing the lamp voltage to shut down the circuit, this lamp circuit does not protect the lamp from circumstances when the lamp current remains constant and the lamp voltage rises thus causing excess power to dissipate into the lamp.

Another known method is provided in U.S. Pat. No. 6,011,363 to Allison. This patent shows a constant wattage electronic ballast circuit which produces a voltage feedback signal from the lamp. The voltage feedback signal is processed to produce a processed signal which is further summed up with the current feedback signal from the lamp to create a summed signal. The lamp current is automatically adjusted in response to the difference between the summed signal and a reference signal. The power of the lamp is controlled by regulating the current of the lamp. One problem with regulating only the lamp current is that the light output of the lamp is more closely related to the arc power of the lamp than to the lamp current. Lamp voltage, however, is dependent on the temperature of the lamp. Therefore, if only current is regulated, the arc power, and hence, light output, will vary with the temperature of the lamp. Further, when only lamp current is regulated, increases in the impedance of the lamp caused by aging results in increased power dissipation. As a result of these factors, portions of the gas discharge lamp reach excessive temperatures. This can present a dangerous fire hazard and can cause the glass envelope of the lamp to shatter, posing an immediate safety hazard for persons in the vicinity of the lamp.

Another known method is provided in U.S. Pat. No. 6,232,727 to Chee et al. which shows a circuit controlling the illumination intensity of the lamp by regulating and/or controlling the arc power delivered to the lamp network. The level of the power provided to the lamp is sensed by providing a regulated voltage to a lamp network or by sensing current leaving the lamp network. The power provided to the lamp network is controlled by adjusting the frequency of the voltage provided to the lamp network. However, again, only by controlling the voltage provided to the lamp network, the power provided to the lamp is controlled such that the user selected illumination intensity output for the lamp is maintained.

Therefore, a need exists to provide a control circuit for a gas discharge lamp that overcomes these disadvantages and provide a substantially constant light output throughout the life of the lamp.

SUMMARY OF THE INVENTION

The present invention provides a method and apparatus for controlling the operation of an arc ballast lamp. The invention includes a ballast circuit for providing power to the lamp, a monitoring circuit for receiving voltage signal and the current signal drawn by the lamp, a dividing circuit for obtaining a signal representative of the lamp resistance based on the lamp's voltage and current signal, and a comparator circuit for adjusting the power provided to the lamp in response to the signal received from the dividing circuit, to maintain a substantially constant light output from the lamp.

DETAILED DESCRIPTION OF THE PREFERRED EMBODIMENT

Figure 1A:
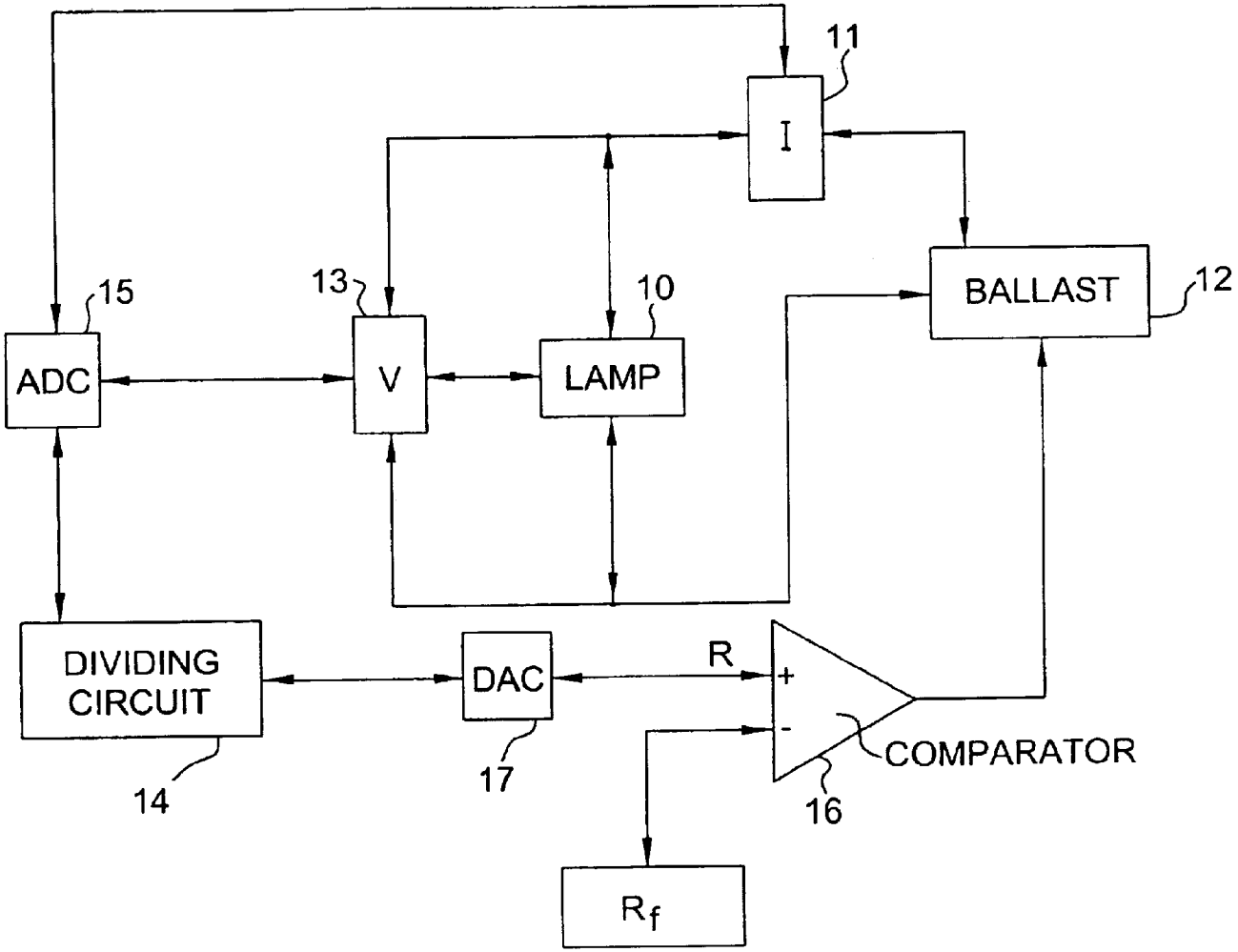
FIG. 1*a* is a schematic block diagram illustrating a power regulating circuit for controlling the power supplied to a gas discharge lamp for maintaining a substantially constant light output of the lamp.

Referring to FIG. 1*a,* there is shown a power regulating circuit for controlling the power supplied to a gas discharge lamp to maintain a substantially constant light output of the lamp. A high pressure gas discharge lamp, 10, such as a mercury arc, metal halide enhanced mercury lamp, or a xenon-metal halide lamp, is controlled by a ballast 12. Ballast 12 adjusts the level of power supplied to lamp 10. Ballast 12 is responsive to a signal received by a comparator 16.

The current feedback (I), 11 is an analog signal received from the lamp, 10. I, 11 is converted from an analog signal to a digital signal by analog to digital converter (APC), 15. Similarly, the voltage feedback (V), 13 is an analog signal received from the lamp 10. V, 13 is also converted from analog signal to a digital signal by ADC 15. The converted digital voltage, V 13 and the digital current, I, 11 is received by a dividing circuit, 14 which divides the voltage signal by current signal, to provide a signal R representative of the lamp resistance R, which is a digital signal is received by a digital to analog converter (DAC) 17. The digital signal of resistance R is converted back into a analog signal, by DAC 17. The comparator 16, typically a differential amplifier, receives the analog R signal in its upper input. The lower input of the comparator 16 is a reference signal, $R_f$, representing target resistance value. The reference signal $R_f$ is adjustable and can preferably be manipulated to determine what balance of lamp life is needed to maintain a substantial consistency in the light output or irradiance. The comparator 16 compares the analog signal R with $R_f$ and based on the comparison determines whether or not to adjust the ballast power provided by ballast 12 to the lamp 10. A control signal derived from the comparator 16 is an indicator to the ballast 12 to adjust the power level supplied to the lamp 10. For instance, if the lamp resistance R compared to the $R_f$ is high, the comparator 16 sends a control signal indicating ballast 12 to increase the electric power provided to the lamp 10 in order to compensate for the ultraviolet power (UV) loss due to increase in lamp resistance R. This provides a consistent UV power over time, thereby minimizing a critical process variable normally associated with photopolymerization. The consistent UV power maintains a constant light output or illumination intensity of the lamp 10 as will be described in greater detail below. The control signal derived from the comparator 16 may desirably be an analog signal as discussed above or, the control signal may preferably be converted to a digital signal by an analog to digital converter (not shown).

The ballast 12 may preferably receive the control signal from the comparator 16 to adjust the power provided to the lamp 10. In other words, the voltage V, 13 and current I, 11 of the lamp 10 need to be adjusted since Power (P)=VI. Ballast 12 in turn may increase or decrease the I ,11 and the V, 13 output of the lamp 10, which in turn increases or decreases the ballast output power I, i.e., the ballast light output. It is known that a gradual increase in the lamp resistance normally occurs with use. A typical range of lamp resistance under steady state operating conditions is from 5.9 ohms for a new lamp to 14.8 ohms for an aged lamp. Since resistance is proportional to the measured loss in UV power density, increase in lamp resistance will also increase the UV power loss in the lamp 10 which will lower the light output. Therefore, in order to compensate for the UV power loss in the lamp, the ballast power VI provided to the lamp 10 is increased by increasing the V, 13 and I, 11 of the lamp 10 to maintain a consistency in the light output.

Figure 2:
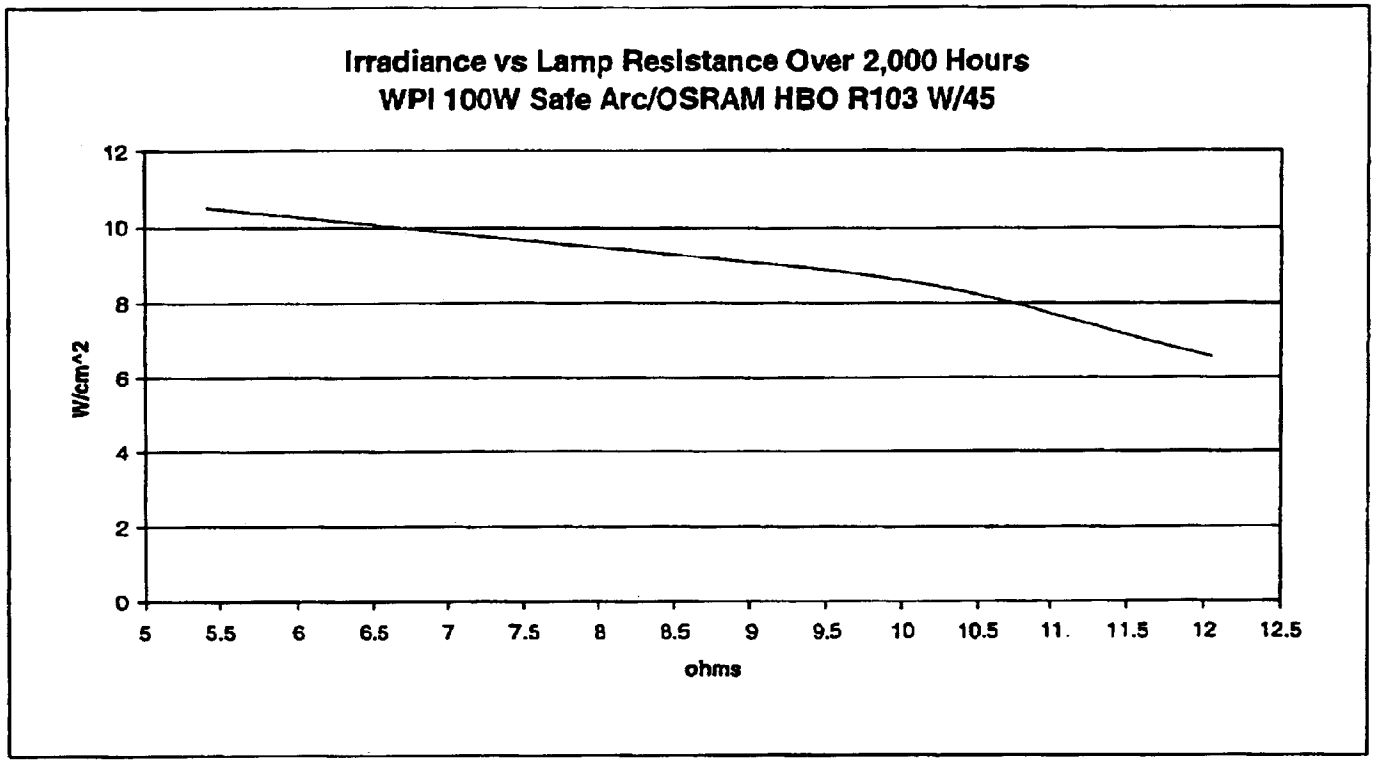
FIG. 2 is a graphical representation illustrating irradiance-lamp resistance characteristics of the circuit.

As discussed above, the ballast 12 adjusts the voltage 13 and current 11 of the lamp 10. Therefore, the ballast 12 acts as a power regulating source providing sufficient increasing (nearly linear) power for the lamp 10 as shown in FIG. 2. FIG. 2 is a graphical representation based on empirical data illustrating the linear relationship between the lamp resistance and UV irradiance over a period of 2,000 hours. The measured data clearly indicates that the irradiance gradually increases as the lamp resistance reduces.

Ballast 12 is known electrical device or chip used in fluorescent and HID fixtures for starting and regulating fluorescent and high intensity discharge lamps. The warm up time for HID lamps is several minutes. In this period, the resistance of the lamp continuously increases from a low value such as 6 ohms, 400 W to an essentially higher nominal value such as 40 ohms, 400 W. During the startup and warm up period, the circuit in FIG. 1*a* is bypassed by some sort of time constant device since the lamp/ballast circuit experiences a series of transients at start up. The start up voltage applied to an HBO type lamp is several kV. Then once the arc is established, the voltage gradually increases while the current drops off. The compensating circuitry should be engaged once the system has reached steady state operating conditions. This can be done by recognition of a given electrical characteristic such as the lamp power or by installing a timing circuit that allows the warm up period to reach completion.

Figure 1B:
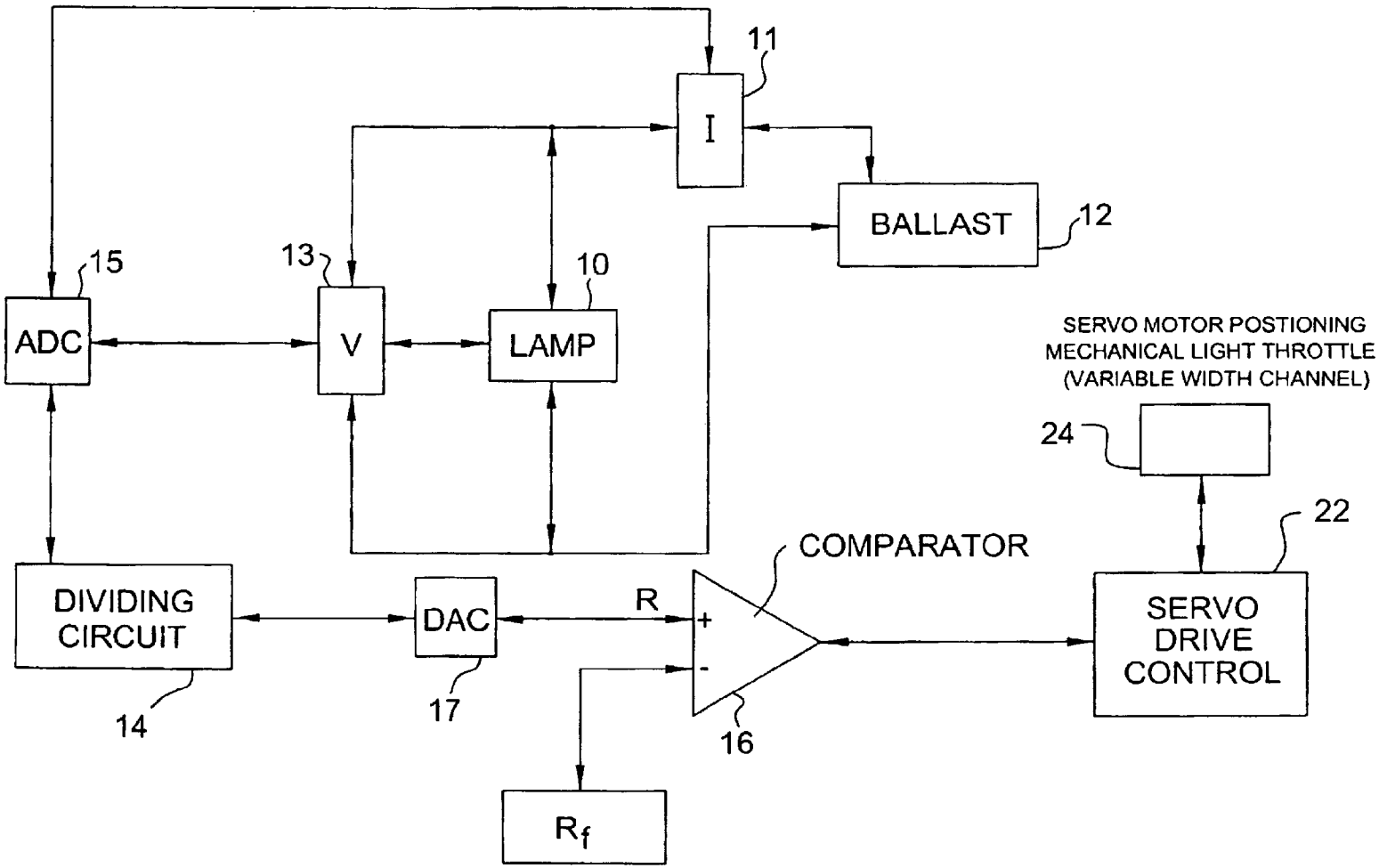
FIG. 1*b* is a schematic block diagram illustrating a power regulating circuit for an electromechanical driven motor.

Similarly, as shown in the circuit in FIG. 1*b,* as an alternate to the electronic feedback to ballast 12, the sensing circuits output signal, i.e. the control signal derived from the comparator 16 can preferably be used to set a mechanical (electro-mech) motor driven light template. The light template is a flat, dimensionally stable metal with a variable width arc channel cut through it. It is essentially a light throttle 24. It is rotated by means of a servo 22 or stepper type motor in the light field, thus allowing more or less light to pass through to the entrance of the light guide, depending on the direction its moving. It can be applied as a compensating device by initially setting its position at an intermediate point. The feedback signal from the circuitry is applied to the servo drive 22 or step drive so the template moves in the increased light direction as the lamp resistance increases. For example, the system irradiates UV energy at 10 W/cm$^2$ with zero attenuation, (the light guide allows energy directed towards the end of the light guide to pass). The template is. set to 5 W/cm$^2$ when the lamp is new. As the lamp ages and the internal resistance increases, the template is gradually rotated to allow more light to pass, thereby maintaining a constant, or near constant, output of 5 W/cm$^2$. So, instead of changing or adjusting the power of the lamp 10, the output signal mechanically compensates for the constant output to the servo drive control 22 for servo motor positioning mechanical light throttle 24.

It is known that increasing the power in lamp 10 will also decrease the life of the lamp. So, in order to help maintain the lamp life while also maintaining consistent irradiance, it is preferred to use the offset arc technique, to preset the circuit of FIG. 1*a* Also, it is known that initially de-focusing the arc so that it burns gradually into focus, with respect to the reflector, is an effective method of improving the irradiance consistency. The lamp 10 preferably includes an arc gap that is intentionally out of focus with respect to a reflector. This results in less output, i.e. irradiance. However, as the electrodes decay, the arc burns into focus, thus compensating for the change in electrical properties. The circuit of FIG. 1*a* would not become "active" until the lamp power reaches a certain level, thereby a time delay. This can be done preferably by measuring the lamp voltage, V to a fixed signal to turn on a transistor switch (not shown) enabling the circuit in FIG. 1*a*. So, a preferred embodiment of the present invention is to use the offset arc technique until the lamp's electrical operating characteristics indicate that the arc is achieved optimal positioning. At that point, the electrical parameters can be used to employ the constant output circuit of FIG. 1*a*. This can be accomplished as mentioned above, using a transistor switching circuit. This technique will help to extend the useful life of the lamp in addition to maintaining consistent irradiance.

As it is known, lamps generally have rise in the voltage during their life time. Ballast 12 keeps the lamp power within an acceptable power range. The acceptable power range for a 100 W mercury arc or mercury based metal halide lamps, specifically OSRAM HBO 100 W lamps may preferably be in the range of 80 to 115 watts which does not deviate more or less than 1% of its normal watts. The lamp is desirably operated at about 83 Watts initially and gradually increasing the power. The same principle of starting the lamp below the power rating to increase the range of compensation can be applied to lamps of other power ratings. By doing this, the operating consistency and lamp life greatly increases. The irradiance that is sacrificed is insignificant with respect to the adhesive curing process. As well known, the UV lamp is used to cure certain compounds such as adhesives and the like preferably used to permanently secure the reflector. So, by maintaining the lamp output power, the photocuring adhesives process is ultimately achieved. Also, any small fluctuation in current can cause extinction or a very fast current increase, which can damage the lamp resulting in a practically short circuited voltage source. The ballast 12 also acts as a current source allowing the lamp to determine its voltage.

While the invention has been described by the foregoing detailed description in relation to the preferred embodiments with several examples, it will be understood by those skilled in the art that various changes may be made without deviating from the spirit and scope of the invention as defined in the appended claims.

What is claimed is:

1. A method of controlling an operation of a gas discharge lamp, comprising:

monitoring a voltage signal and current signal of the lamp;

determining a lamp resistance based on the voltage signal and the current signal; and adjusting power provided to the lamp based on the measured lamp resistance to maintain a substantially constant light output.

2. The method of claim 1 further comprising the step of comparing the measured lamp resistance with a reference signal wherein said reference signal represents a target resistance value.

3. The method of claim 2 wherein said reference value is adjustable.

4. The method of claim 2 wherein said reference value is fixed.

5. The method of claim 2, wherein said power is adjusted if the lamp resistance compared to the reference signal is high.

6. The method of claim 1, wherein said adjusting step comprises of adjusting the voltage and the current signal of the lamp.

7. The method of claim 1, wherein said voltage and current signals are analog signals.

8. The method of claim 7, wherein said voltage and current signals are converted from the analog signals to digital signals.

9. The method of claim 8, wherein said resistance is determined based on the converted digital signals of the voltage and current signals.

10. The method of claim 1, wherein said resistance is determined by dividing the voltage signal with the current signal.

11. The method of claim 1, wherein said resistance is a digital signal.

12. The method of claim 11 , wherein said resistance is converted from the digital signal to analog signal.

13. The method of claim 1 wherein said power is in the range of 80 to 115 watts.

14. An apparatus for controlling an operation of a gas discharge lamp, comprising:

a ballast circuit for providing power to the lamp and monitoring voltage and current signals drawn by the lamp;

a dividing circuit for dividing the voltage and current signal obtaining a signal representative of the lamp resistance based on the voltage signal and the current signal; and a comparator circuit for indicating to the ballast circuit to adjust the power provided to the lamp in response to the signal received from the dividing circuit, to maintain a substantially constant light output from the lamp.

15. The apparatus of claim 14 wherein said comparator circuit compares the signal representing the lamp resistance with a reference signal, wherein said reference signal represents target resistance value.

16. The apparatus of claim 15 wherein said reference signal is adjustable.

17. The apparatus of claim 15 wherein said reference signal is fixed.

18. The apparatus of claim 15, wherein said power is adjusted if the lamp resistance is high compared to the reference signal.

19. The apparatus of claim 14, wherein the lamp resistance is representative of a level of the power provided to the lamp.

20. The apparatus of claim 14, further comprises of an analog to digital converter for converting the voltage an d current signals from analog signals to digital signals prior to being received by the dividing circuit.

21. The apparatus of claim 14, wherein said comparator circuit comprises a differential amplifier.

22. The apparatus of claim 14, wherein said dividing circuit comprises of a divider for dividing the voltage signal with the current signal to obtain the lamp resistance.

23. The apparatus of claim 14 wherein said power is in the range of 80 to 115 watts.

24. An apparatus for controlling an operation of an electro-mechanical driven motor, comprising:

a ballast circuit for providing power to a lamp and monitoring voltage and current signals drawn by the lamp;

a dividing circuit for dividing the voltage and current signal obtaining a signal representative of the lamp resistance based on the voltage signal and the current signal; and a comparator circuit for comparing the signal representing the lamp resistance with a reference signal for adjusting the power provided to said motor, wherein said reference signal represents target resistance value.

25. The apparatus of claim 24, wherein said reference signal is fixed.

26. The apparatus of claim 24, wherein said reference signal is variable.

27. The apparatus of claim 24, wherein the lamp resistance is representative of a level of the power provided to the lamp.

28. The apparatus of claim 24, further comprising an analog to digital converter for converting the voltage and current signals from analog signals to digital signals prior to being received by the dividing circuit.

29. The apparatus of claim 24, wherein said comparator circuit comprises a differential amplifier.

30. The apparatus of claim 24, wherein said dividing circuit comprises of a divider for dividing the voltage signal with the current signal to obtain the lamp resistance.

31. The apparatus of claim 24, wherein said power is in the range of 80 to 115 watts.

* * * * *